US008008966B2

(12) United States Patent
Cho

(10) Patent No.: US 8,008,966 B2
(45) Date of Patent: Aug. 30, 2011

(54) START-UP CIRCUIT FOR GENERATING BANDGAP REFERENCE VOLTAGE

(75) Inventor: Eun Sang Cho, Seoul (KR)

(73) Assignee: Dongbu HitekCo., Ltd (KR)

( * ) Notice: Subject to any disclaimer, the term of this patent is extended or adjusted under 35 U.S.C. 154(b) by 483 days.

(21) Appl. No.: 12/262,057

(22) Filed: Oct. 30, 2008

(65) Prior Publication Data

US 2009/0140714 A1 Jun. 4, 2009

(30) Foreign Application Priority Data

Dec. 3, 2007 (KR) ..... 10-2007-0124439

(51) Int. Cl.
*G05F 1/10* (2006.01)

(52) U.S. Cl. ..... 327/539; 327/513; 323/313

(58) Field of Classification Search ..... 327/350, 327/513, 538–543; 323/311–316, 906, 907
See application file for complete search history.

(56) References Cited

U.S. PATENT DOCUMENTS

| | | | | |
|---|---|---|---|---|
| 6,906,581 | B2 * | 6/2005 | Kang et al. | 327/539 |
| 7,119,620 | B2 * | 10/2006 | Pan | 330/289 |
| 7,224,209 | B2 * | 5/2007 | Hsu | 327/538 |
| 7,342,390 | B2 * | 3/2008 | Tachibana et al. | 323/316 |
| 7,602,236 | B2 * | 10/2009 | Jo | 327/539 |

* cited by examiner

*Primary Examiner* — Rajnikant B Patel
(74) *Attorney, Agent, or Firm* — Workman Nydegger

(57) ABSTRACT

Disclosed is a start-up circuit that can stably and rapidly start up a bandgap reference voltage generating circuit when the bandgap reference voltage generating circuit is switched from a sleep mode to an operation mode, even if a difference in electrical characteristic, such as DC offset or the like, occurs due to, e.g, a physical difference between input transistors of an operational amplifier.

8 Claims, 4 Drawing Sheets

START-UP CIRCUIT FOR GENERATING BANDGAP REFERENCE VOLTAGE

CROSS-REFERENCE TO RELATED APPLICATION

This application claims priority to Korean Application No. 10-2007-0124439, filed on Dec. 3, 2007, which is incorporated herein by reference in its entirety.

BACKGROUND

1. Field of the Invention

Embodiments of the present invention relate to a start-up circuit for a bandgap reference voltage generating circuit that can realize a fast start-up when the bandgap reference voltage generating circuit is switched from a sleep mode to an operation mode and can maintain a stable bandgap output voltage.

2. Description of Related Art

In a semiconductor integrated circuit, in order to ensure reliability of the entire system, a stable internal reference voltage should be maintained. That is, even if an external power supply voltage or temperature, or a semiconductor integration process is changed, in order for individual devices to function properly, the reference voltage used in the integrated circuit should be stably maintained. For this purpose, reference voltage generating circuits which are designed to supply a stable and constant reference voltage are provided.

Among the reference voltage generating circuits, a bandgap reference voltage generating circuit using a bipolar transistor is widely used. In general, the bandgap reference voltage generating circuit includes a start-up circuit that stably restarts the circuit when the bandgap reference voltage generating circuit is switched from a sleep mode to an operation mode. FIG. 1 is a circuit diagram of a known bandgap reference voltage generating circuit.

As shown in FIG. 1, the known bandgap reference voltage generating circuit outputs a bandgap output voltage Vbg that is used as a reference voltage. The known bandgap reference voltage generating circuit includes a temperature compensating circuit, an operational amplifier Op-Amp, a PMOS transistor MP11 (hereinafter MP represents a PMOS transistor, and MN represents an NMOS transistor), and a start-up circuit 100. The temperature compensating circuit includes bipolar transistors Q1 and Q2, and a resistor R3. The operational amplifier Op-Amp has a first input terminal Inn to which a voltage is input from an emitter of the bipolar transistor Q1, and a second input terminal Inp to which a voltage is input from an emitter of the bipolar transistor Q2 through the resistor R3. The operational amplifier Op-Amp outputs a voltage at a constant level on the basis of the input voltages. The PMOS transistor MP11 is turned on/off according to a voltage fed back from the output of the operational amplifier Op-Amp and supplies a reference current to the bipolar transistors Q1 and Q2. When the bandgap reference voltage generating circuit is switched from the sleep mode to the operation mode, the start-up circuit 100 is designed to enable the bandgap reference voltage generating circuit to stably start up.

The temperature compensating circuit is designed such that the known bandgap reference voltage generating circuit supplies a stable voltage without being influenced by a change in temperature. In particular, the temperature compensating circuit supplies, to the operational amplifier Op-Amp, a voltage of a PTAT (proportional to absolute temperature) circuit (having the bipolar transistor Q2 and the resistor R3), which increases with an increase in temperature, that is, has a positive temperature coefficient. The temperature compensating circuit also supplies a voltage of a base-emitter junction (bipolar transistor Q1), which decreases with a decrease in temperature, that is, has a negative temperature coefficient. The operational amplifier Op-Amp adds the two voltages supplied thereto and the increase and decrease in the voltages depending on the temperature cancel each other. Therefore, a stable voltage can be supplied without being influenced by the change in temperature.

The terminals of the operational amplifier Op-Amp to which the two voltages are input, that is, the first input terminal Inp and the second input terminal Inn, include MOS transistors (hereinafter, referred to as input transistors). The input transistors are designed to have the same performance. Therefore, if the two input transistors are manufactured as designed, ideally, a stable voltage can be supplied.

However, during actual manufacturing, it may be impossible to manufacture the two input transistors to ideally have the same performance. That is, a physical difference between the portions constituting the transistors, for example, a difference in channel length or source/drain depth may occur. Such a physical difference leads to a difference in electrical performance between the two input transistors, which adversely affects the stability of the reference voltage. For example, if a DC offset (i.e., a difference in drain voltage between the input transistors) is equal to or more than 0.11% of the set reference voltage, the bandgap output voltage may merely reach approximately 33% of the normal value, causing a fatal error. FIG. 2 shows a case (200) where the DC offset of the input transistors is 0% and accordingly the bandgap output voltage becomes stable, for example, at 1.2 V, and a case (210) where the DC offset is approximately 0.11% and accordingly the bandgap output voltage is merely at approximately 0.4 V. Thus, a failure occurs in the bandgap output voltage.

In the known bandgap reference voltage generating circuit, a failure occurs in the bandgap output voltage due to a difference in performance between the input transistors because the operational amplifier Op-Amp amplifies a difference in voltage at the input terminals 1000 times or more during an open-loop operation. As a result, rapid voltage drop at the output terminal of the operational amplifier Op-Amp is impaired. This will be described below in detail with reference to FIG. 1.

During the sleep mode, if the external power supply voltage pwd, which is applied to the circuit from an external source, is at 3.3 V (that is, "High" level), a voltage pwdb output through an inverter becomes 0 V (that is, "Low" level). The voltage pwdb is applied to the gates of the transistors MP12 and MN12, and the voltage pwd is applied to the gate of the transistor MP13. A PMOS transistor is turned on when a voltage at a "Low" level is applied to the gate thereof, and an NMOS transistor is turned on when a voltage at a "High" level is applied to the gate thereof. Therefore, the transistors MP12 and MN12 are turned on and off, respectively, in the sleep mode since the voltage pwdb is applied to the gates thereof, and the transistor MP13 is turned off in the sleep mode since the voltage pwd is applied to the gate thereof.

As the transistor MP12 is turned on, the source of the transistor MP12 is at the same level as the power supply voltage of 3.3 V, which is connected to the drain of the transistor MP12. Because the transistors MP15 and MN12 are turned off the 3.3 V level is maintained. Since the 3.3 V is applied to the gate of the transistor MP11, the transistor MP11 is kept turned off. Therefore, a reference current does not flow through the transistor MP11, and the bandgap output voltage Vbg is maintained at 0 V.

On the other hand, if the voltage pwd, which is applied to the circuit from an external source, becomes 0 V, the voltage pwdb becomes 3.3 V. Accordingly, because of the same principles described above, the transistor MP12 is turned off, and the transistors MP13 and MN12 in the start-up circuit are turned on. As the transistor MP13 is turned on, a current flows through the transistor MP13. Then, each of the transistors MP14 and MN13 to MN15 functions as a resistor since its gate and drain are connected with each other. Therefore, the voltage at the drain of the transistor MN13 is set at approximately 2.4V. Since the drain of the transistor MN13 is connected to the gate of the transistor MP15, as the voltage at the drain of the transistor MN13 rises to 2.4 V, the transistor MP15 is turned on. Since the drain of the transistor MP15 is connected to the source of the transistor MP12, as the transistor MP15 is turned on, a current flows from the source of the transistor MP12, which is maintained at 3.3 V, to the ground Vss through the transistors MP15 and MN12. At this time, since the transistor MP12 is turned off, the power supply voltage Vdd of 3.3 V is not supplied through the transistor MP12 and the voltage at the source of the transistor MP12 falls from 3.3 V to below 3.3V and reaches approximately 2.1 V, and accordingly the transistor MP11 is turned on. If the transistor MP11 is turned on, the reference current flows from the drain of the transistor MP11 to the operational amplifier Op-Amp along the transistor MP11, and the bandgap output voltage Vbg rises from 0 V to 1.2 V. Thus, a stable bandgap output voltage Vbg is output because the voltage at the output terminal of the operational amplifier Op-Amp (that is, the source of the transistor MP12) rapidly and stably falls, and the voltage applied to the gate of the transistor MP11 is maintained stably to keep the transistor MP11 turned on.

In the known bandgap reference voltage generating circuit, the transistor MP15 is a PMOS transistor and has a threshold voltage Vth of approximately 0.9 V. Accordingly, in a state where 2.4 V is applied to the gate of the transistor MP15, if the voltage at the drain of the transistor MP15 falls from 3.3 V and becomes less than 3.0 V, the drain-gate voltage Vdg becomes lower than the threshold voltage Vth. Therefore, a discharge driving force applied to the transistor MP12 by the transistor MP15 is weakened, and a current flows insufficiently, causing a lower voltage drop at the source of the transistor MP12.

At this time, if the DC offset between the input transistors of the operational amplifier Op-Amp occurs, voltage drop at the source of the transistor MP12 may be further reduced. This is because the output voltage of the operational amplifier Op-Amp is connected to the source of the transistor MP12 and is further increased when, during open-loop operation, the operational amplifier Op-Amp amplifies the DC offset between the input transistors 1000 times or more. Consequently, the turned-on state of the transistor MP11, whose gate is connected to the source of the transistor MP12, may be made unstable. If the transistor MP11 is made unstable, the bandgap output voltage Vbg may become significantly lower than the normal value. FIG. 2 shows the bandgap output voltages when the DC offset is 0% (200) and when the DC offset is 0.11% (210). From this, it can be seen that, when the DC offset is 0.11%, the bandgap output voltage is abnormally at 0.4 V, which is significantly lower than the ideal level of 1.2 V, when the DC offset is 0%.

This abnormal output state of the bandgap output voltage may adversely affect driving of the semiconductor circuit, which uses the bandgap output voltage as a reference voltage, and the reliability of the semiconductor device may be deteriorated.

SUMMARY OF SOME EXAMPLE EMBODIMENTS

In general, example embodiments of the invention relate to a start-up circuit that can stably and rapidly start up a bandgap reference voltage generating circuit when the bandgap reference voltage generating circuit is switched from a sleep mode to an operation mode, even if a difference in electrical characteristic, such as a DC offset or the like, occurs due to, e.g., a physical difference between input transistors of an operational amplifier.

According to a first embodiment, a start-up circuit for a bandgap reference voltage generating circuit includes a first PMOS transistor having a drain connected to a power supply terminal, and a source and a gate connected with each other. The start-up circuit also includes a first NMOS transistor having a drain connected to the source of the first PMOS transistor and a gate connected to a bandgap output terminal; and a second NMOS transistor having a drain connected to a source of the first NMOS transistor, a source connected to a ground terminal, and a gate to which a first mode signal is applied. The start-up circuit further includes a third NMOS transistor having a drain connected to an output terminal of an operational amplifier Op-Amp and a gate connected to the drain of the first NMOS transistor; and a fourth NMOS transistor having a source connected to the ground terminal, a drain connected to a source of the third NMOS transistor, and a gate to which the first mode signal is applied.

The bandgap reference voltage generating circuit may further include a fifth NMOS transistor having a drain connected to the bandgap output terminal, a source connected to the ground terminal, and a gate to which a second mode signal is applied, the first mode signal being an inverse of the second mode signal. With this structure, the bandgap output voltage is further ensured to reliably be maintained at 0 V.

A low pass filter may be connected to the bandgap output terminal to remove high-frequency noise from the bandgap output voltage, thereby achieving a stable output state. The low pass filter may include a resistor connected in series to the bandgap output terminal, and a capacitor connected between the bandgap output terminal and the power supply terminal. The resistor and the capacitor may each comprise a PMOS transistor.

According to embodiments of the present invention, when the bandgap reference voltage generating circuit is switched from a sleep mode to an operation mode, stable start-up can be performed, and thus a stable output can be obtained rapidly. In addition, even if a DC offset occurs due to a difference between two input transistors in an operational amplifier, a stable bandgap output voltage can be generated.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

Aspects of example embodiments of the invention will become apparent from the following description of example embodiments given in conjunction with the accompanying drawings, in which.

DETAILED DESCRIPTION OF SOME EXAMPLE EMBODIMENTS

Figure 1:
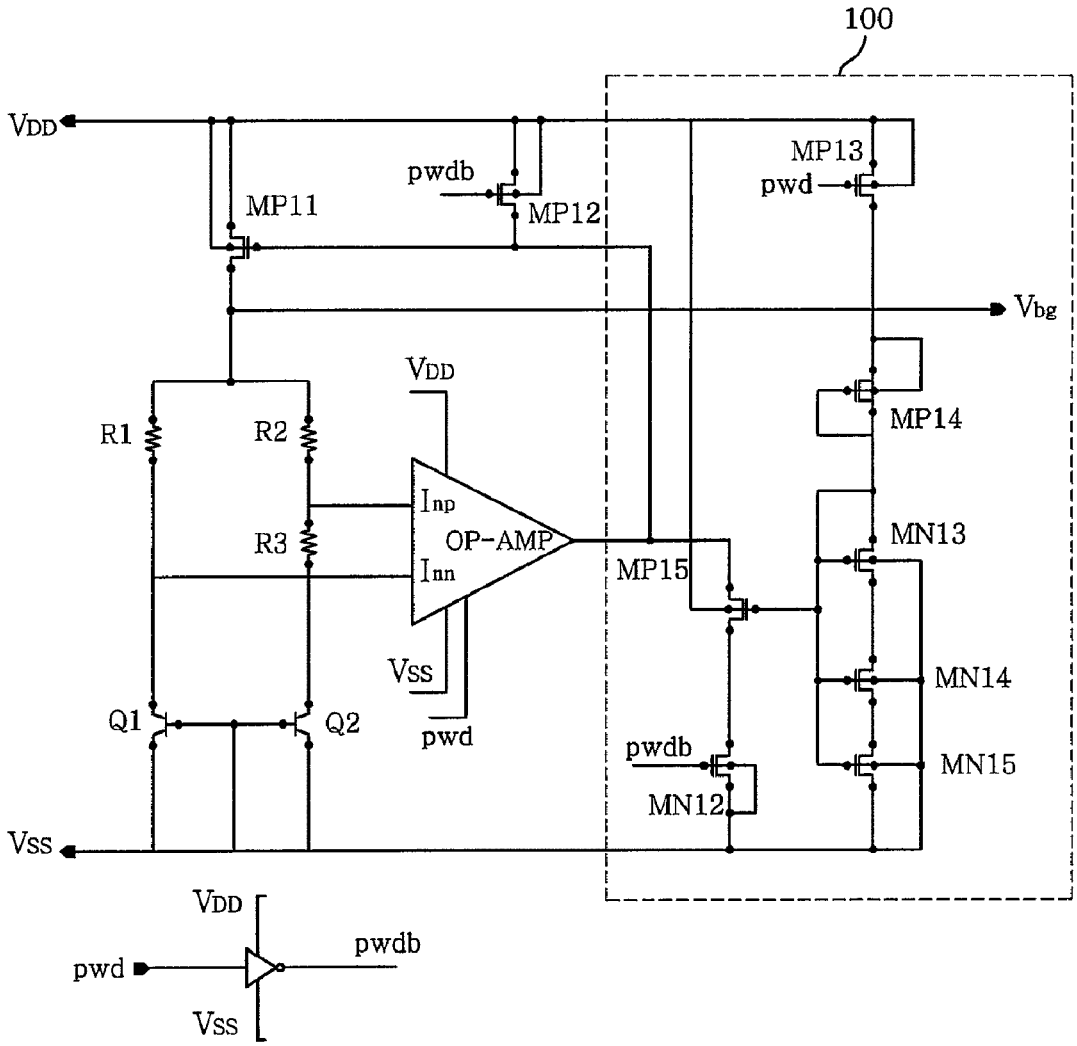
FIG. 1 (PRIOR ART)
FIG. 1 is a circuit diagram of a known bandgap reference voltage generating circuit.
Figure 2:
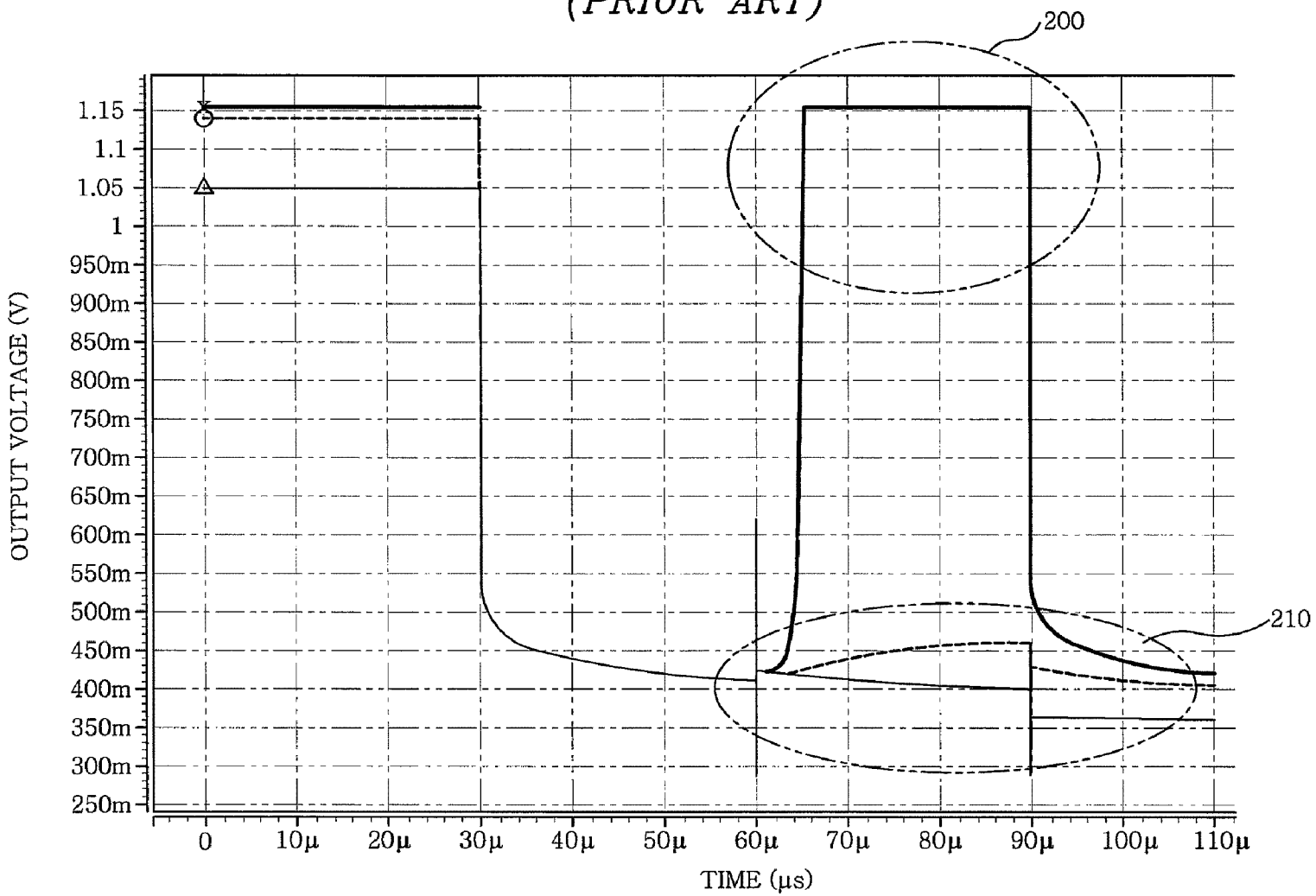
FIG. 2 (PRIOR ART)
FIG. 2 is a diagram illustrating abnormal characteristics of a bandgap output voltage in the known bandgap reference voltage generating circuit.
Figure 3:
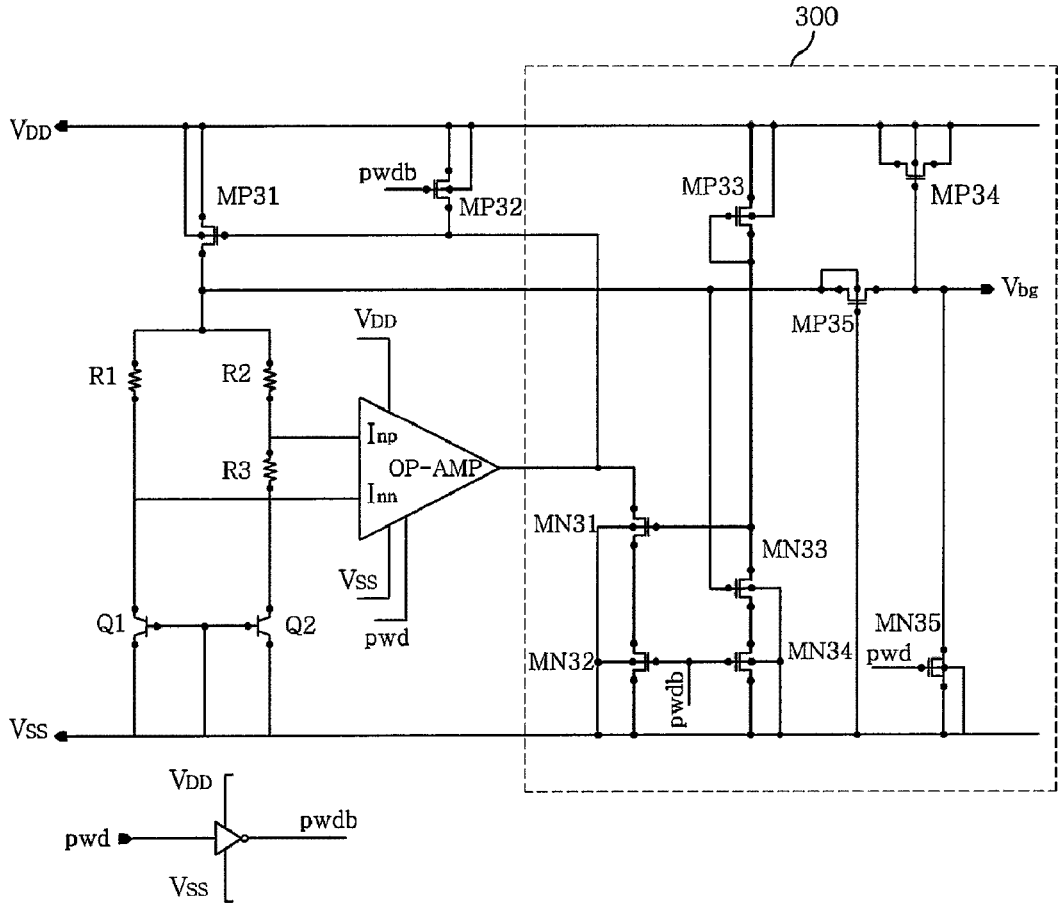
FIG. 3 is a circuit diagram of a bandgap reference voltage generating circuit according to an embodiment of the present invention.

In the following detailed description of the embodiments, reference is made to the accompanying drawings that show, by way of illustration, specific embodiments of the invention. In the drawings, like numerals describe substantially similar components throughout the several views. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled. FIG. 3 is a circuit diagram of a bandgap reference voltage generating circuit including a start-up circuit 200 according to an embodiment of the present invention.

During the sleep mode, an external power supply voltage pwd (i.e., a sleep/operation mode signal) may be applied to the circuit from an external source. The external power supply voltage pwd may be set at 3.3 V to indicate a sleep mode. Voltage pwdb may be output through an inverter at a level of 0 V, i.e., the inverse of voltage pwd. Therefore, a transistor MP32 may be turned on, and transistors MN32 and MN34 may be turned off by virtue of receiving 0 V (voltage pwdb) at their respective gates. When the transistor MP32 is turned on, the voltage at a source of the transistor MP32 becomes 3.3 V, which may be applied to a drain of the transistor MP32. Then, 3.3 V is applied to a gate of a transistor MP31, and the transistor MP31 is turned off. Since a gate of a transistor MN33 is connected to a bandgap output terminal, if a bandgap output voltage is at 0 V, the transistor MN33 is turned off, and the transistor MN34 is also turned off. The transistor MP33 functions as a resistor since its gate and drain are connected with each other. Therefore, the voltage at the drain of the transistor MN33 becomes 3.3 V, and the transistor MN31 whose gate is connected to the drain of the transistor MN33 is also turned on.

Since the transistor MN32 is turned off, a current at the source of the transistor MP32 does not flow into the ground terminal Vss, and the voltage at the source of the transistor MP32 is therefore maintained at 3.3 V. Therefore, during the sleep mode, the transistors MP32 and MN31 are kept turned on, and the transistors MP31, MN32, and MN34 are kept turned off. As a result, the bandgap output voltage Vbg is maintained at 0 V.

When switching from the sleep mode to the operation mode, the external power supply voltage pwd is changed from 3.3 V to 0 V and the voltage pwdb is changed from 0 V to 3.3 V. Then, the transistor MP32 is turned off, and the transistors MN32 and MN34 are turned on. Therefore, a current is discharged from the source of the transistor MP32 to the ground terminal Vss through the transistors MN31 and MN32, and thus the voltage at the source of the transistor MP32 falls from 3.3 V. Voltage drop at the source of the transistor MP32 causes the transistor MP31 to be turned on, and a current flows through the transistor MP31. As a result, the bandgap output voltage Vbg rises from 0 V to 1.2 V. The source of the transistor MP32 is connected to the output terminal of the operational amplifier Op-Amp. Therefore, the voltage at the output terminal of the operational amplifier Op-Amp falls rapidly along with the voltage at the source of the transistor MP32.

Voltage drop at the output terminal of the operational amplifier Op-Amp can be rapidly and stably made, as compared with the related art. That is, during the operation mode, the transistor MN31 connected to the output terminal of the operational amplifier Op-Amp is an NMOS transistor. Therefore, unlike the related art in which the PMOS transistor is used, there is no case where the drain-gate voltage Vdg becomes lower than the threshold voltage Vth, and the discharge driving force is weakened. As a result, the voltage at the output terminal of the operational amplifier Op-Amp (that is, the source of the transistor MP32) falls rapidly and stably.

As described above, therefore, even if the voltage at the output terminal of the operational amplifier Op-Amp is increased due to a difference in electrical characteristic, such as DC offset or the like, between the input transistors of the operational amplifier Op-Amp, the increase is rapidly canceled by a voltage drop through the transistors MN31 and MN32. As a result, deterioration of an output characteristic due to the difference between the input transistors can be prevented.

Moreover, once the voltage at the bandgap output terminal changes from 0 V to 1.2 V, current is no longer discharged through the transistors MN31 and MN32 and the voltage at the output terminal of the operational amplifier Op-Amp is maintained stably. For example, when the bandgap output terminal voltage is 1.2 V, the transistors MN33 and MN34 are turned on and have a small resistance of several ohms. The transistor MP33, however, by virtue of its channel length and width, has a resistance of several megaohms. Thus, a current at the drain of the transistor MN33 is discharged to the ground terminal Vss through the transistors MN33 and MN34, and as a result, the voltage at the drain of the transistor MN33 falls from 3.3 V to 0 V. Therefore, the voltage at the gate of the transistor MN31 which is connected to the drain of the transistor MN33 falls to 0 V, and thus the transistor MN31 is also turned off. For this reason, current discharge at the output terminal of the operational amplifier Op-Amp through the transistors MN31 and MN32 no longer occurs, and the voltage at the output terminal of the operational amplifier Op-Amp is maintained stably. As a result, the bandgap output voltage is also maintained at 1.2 V.

A transistor MN35 may also be provided at the bandgap output terminal. The transistor MN35 may have a drain connected to the bandgap output terminal, a source connected to the ground terminal Vss, and a gate to which the voltage pwd is applied. With this structure, during the sleep mode (that is, when the external power supply voltage pwd is at 3.3 V), the transistor MN35 may be turned on, and a current may flow from the bandgap output terminal toward the ground terminal Vss. Therefore, the bandgap output voltage may be further ensured to reliably be maintained at 0 V. Consequently, in a circuit that uses the bandgap output voltage as a reference voltage, wasteful power consumption can be suppressed.

As occasion demands, when the bandgap output voltage is rapidly changed from 0 V to 1.2 V, the voltage may exceed 1.2 V for a brief instant, that is, a glitch may occur. The glitch mostly includes high pass frequency components, and may cause an erroneous operation in the semiconductor circuit. Therefore, in order to prevent the glitch, a low pass filter may be provided to filter the high pass frequency component from the bandgap output voltage and to pass only low pass frequency components.

The low pass filter may comprise transistors MP35 and MP34 shown in FIG. 3. The transistor MP35 may be connected in series to the bandgap output terminal to function as a resistor. The MP34 may be connected between the bandgap output terminal and the power supply terminal Vdd to function as a capacitor.

Figure 4:
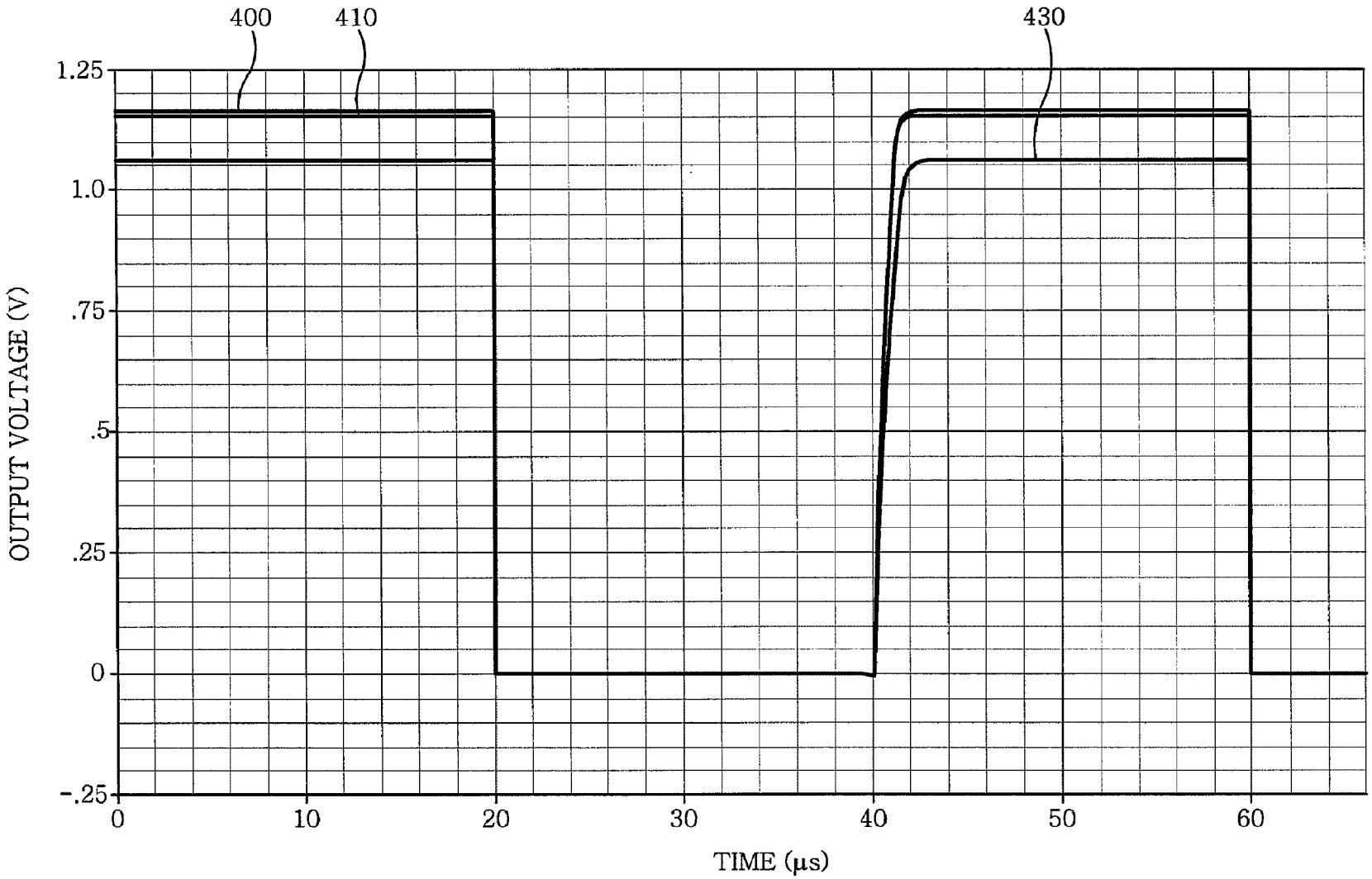
FIG. 4 is a diagram illustrating characteristics of a bandgap output voltage in the bandgap reference voltage generating circuit according to the embodiment of FIG. 3.

FIG. 4 is a diagram illustrating characteristics of a bandgap output voltage according to a difference in DC offset between input transistors when a start-up circuit having the above structure is applied. As shown in FIG. 4, even if the DC offset between the input transistors is 0% (0 mV), 0.11% (1.1 mV) and 1% (10 mV), which are represented as reference numerals 400, 410 and 430, respectively, the bandgap output characteristics are normal, and the deterioration in the bandgap output characteristic is not observed, unlike a case where the known start-up circuit is used. From this, it can be seen that even if the DC offset between the input transistors caused by a transistor manufacturing process reaches 1%, the bandgap output voltage is stably maintained at 1.2 V.

While the invention has been shown and described with respect to the embodiment, it will be understood by those skilled in the art that various changes and modifications may be made without departing from the scope of the invention as defined in the following claims.

What is claimed is:

1. A start-up circuit which is used in a bandgap reference voltage generating circuit, the start-up circuit comprising:

a first PMOS transistor having a drain connected to a power supply terminal, and a source and a gate connected with each other;

a first NMOS transistor having a drain connected to the source of the first PMOS transistor and a gate connected to a bandgap output terminal;

a second NMOS transistor having a drain connected to a source of the first NMOS transistor, a source connected to a ground terminal, and a gate to which a first mode signal is applied;

a third NMOS transistor having a drain connected to an output terminal of an operational amplifier and a gate connected to the drain of the first NMOS transistor; and a fourth NMOS transistor having a source connected to the ground terminal, a drain connected to a source of the third NMOS transistor, and a gate to which the first mode signal is applied.

2. The start-up circuit of claim 1, further comprising:

a fifth NMOS transistor having a drain connected to the bandgap output terminal, a source connected to the ground terminal, and a gate to which a second mode signal is applied, the first mode signal being an inverse of the second mode signal.

3. The start-up circuit of claim 1, further comprising:

a low pass filter connected to the bandgap output terminal.

4. The start-up circuit of claim 3, wherein the low pass filter includes a resistor connected in series to the bandgap output terminal and a capacitor connected between the bandgap output terminal and the power supply terminal.

5. The start-up circuit of claim 4, wherein the resistor and the capacitor each comprise a MOS transistor.

6. The start-up circuit of claim 3, wherein the lowpass filter comprises a plurality of transistors.

7. The start-up circuit of claim 6, wherein at least one of the transistors is connected between the bandgap output terminal and the power supply terminal to function as a capacitor and another at least one of the transistors is connected in series to the bandgap output terminal to function as a resistor.

8. The start-up circuit of claim 1, further comprising a transistor having a drain connected to the bandgap output terminal, a source connected to the ground terminal, and a gate to which the a second mode signal is applied, the first mode signal being an inverse of the second mode signal.

* * * * *